US011454090B2

(12) United States Patent
Gonzalez-Cabrera et al.

(10) Patent No.: US 11,454,090 B2
(45) Date of Patent: Sep. 27, 2022

(54) CHEMICAL TREATMENT WELL TOOL ASSEMBLY PRESSURE CONTAINMENT

(71) Applicant: ODESSA SEPARATOR, INC., Odessa, TX (US)

(72) Inventors: Gustavo A. Gonzalez-Cabrera, Midland, TX (US); Lowell C. Kirkland, Odessa, TX (US); Dañelle N. Campbell, Odessa, TX (US); Daniel L. Culbertson, Odessa, TX (US); Andres J. Perez, Odessa, TX (US); Mark H. Lowe, Odessa, TX (US)

(73) Assignee: Odessa Separator, Inc., Odessa, TX (US)

( * ) Notice: Subject to any disclaimer, the term of this patent is extended or adjusted under 35 U.S.C. 154(b) by 0 days.

(21) Appl. No.: 16/713,821

(22) Filed: Dec. 13, 2019

(65) Prior Publication Data

US 2020/0248532 A1 Aug. 6, 2020

Related U.S. Application Data

(60) Provisional application No. 62/800,963, filed on Feb. 4, 2019.

(51) Int. Cl.
*E21B 34/12* (2006.01)

(52) U.S. Cl.
CPC ..... *E21B 34/12* (2013.01)

(58) Field of Classification Search
CPC ..... E21B 34/12
See application file for complete search history.

(56) References Cited

U.S. PATENT DOCUMENTS

| | | | | |
|---|---|---|---|---|
| 339,809 | A | 4/1886 | Putman | |
| 2,453,741 | A | 11/1948 | Bopp | |
| 2,512,999 | A | 6/1950 | Bruning | |
| 2,548,528 | A | 4/1951 | Hansen | |
| 2,642,139 | A * | 6/1953 | Bedford | E21B 41/02 166/115 |
| 3,994,317 | A | 11/1976 | Miyazaki et al. | |
| 4,819,692 | A * | 4/1989 | Olson | F16L 29/04 137/614.03 |
| 5,388,874 | A | 2/1995 | Barrier | |
| 5,829,480 | A | 11/1998 | Smith, III | |

(Continued)

*Primary Examiner* — Taras P Bemko
(74) *Attorney, Agent, or Firm* — Smith IP Services, P.C.

(57) ABSTRACT

A chemical treatment assembly can include a section including a pressure containment valve that selectively permits and prevents fluid communication with a flow passage in the section, and another section including a pressure containment valve that selectively permits and prevents fluid communication with a flow passage in the section. The pressure containment valves are closed in response to disconnection of the sections. A method of containing pressure in sections of a chemical treatment assembly can include installing a pressure containment valve in each of the sections, the pressure containment valves being configured to close in response to disconnecting the sections. Another chemical treatment assembly can include an outer housing, a flow passage extending longitudinally through the outer housing, a chemical treatment positioned in the flow passage, and a pressure containment valve that selectively permits and prevents fluid communication with the flow passage through the pressure containment valve.

17 Claims, 6 Drawing Sheets

(56) References Cited

U.S. PATENT DOCUMENTS

| | | | | |
|---|---|---|---|---|
| 5,893,391 | A * | 4/1999 | Jenski, Jr. | F16L 37/32<br>137/614 |
| 5,899,228 | A | 5/1999 | Smith, III | |
| 6,206,040 | B1 * | 3/2001 | Smith, III | F16L 1/26<br>137/614.04 |
| 6,808,023 | B2 | 10/2004 | Smith et al. | |
| 8,622,085 | B2 | 1/2014 | June | |
| 8,857,520 | B2 | 10/2014 | Hoffman et al. | |
| 9,611,949 | B2 * | 4/2017 | Pelfrey | F16L 55/1007 |
| 9,909,703 | B2 | 3/2018 | Van Scyoc | |
| 2015/0292638 | A1 * | 10/2015 | Pelfrey | F16L 55/1007<br>251/74 |

* cited by examiner

CHEMICAL TREATMENT WELL TOOL ASSEMBLY PRESSURE CONTAINMENT

BACKGROUND

This disclosure relates generally to equipment utilized and operations performed in conjunction with a subterranean well and, in an example described below, more particularly provides for pressure containment in a chemical treatment well tool assembly.

DETAILED DESCRIPTION

Figure 1:
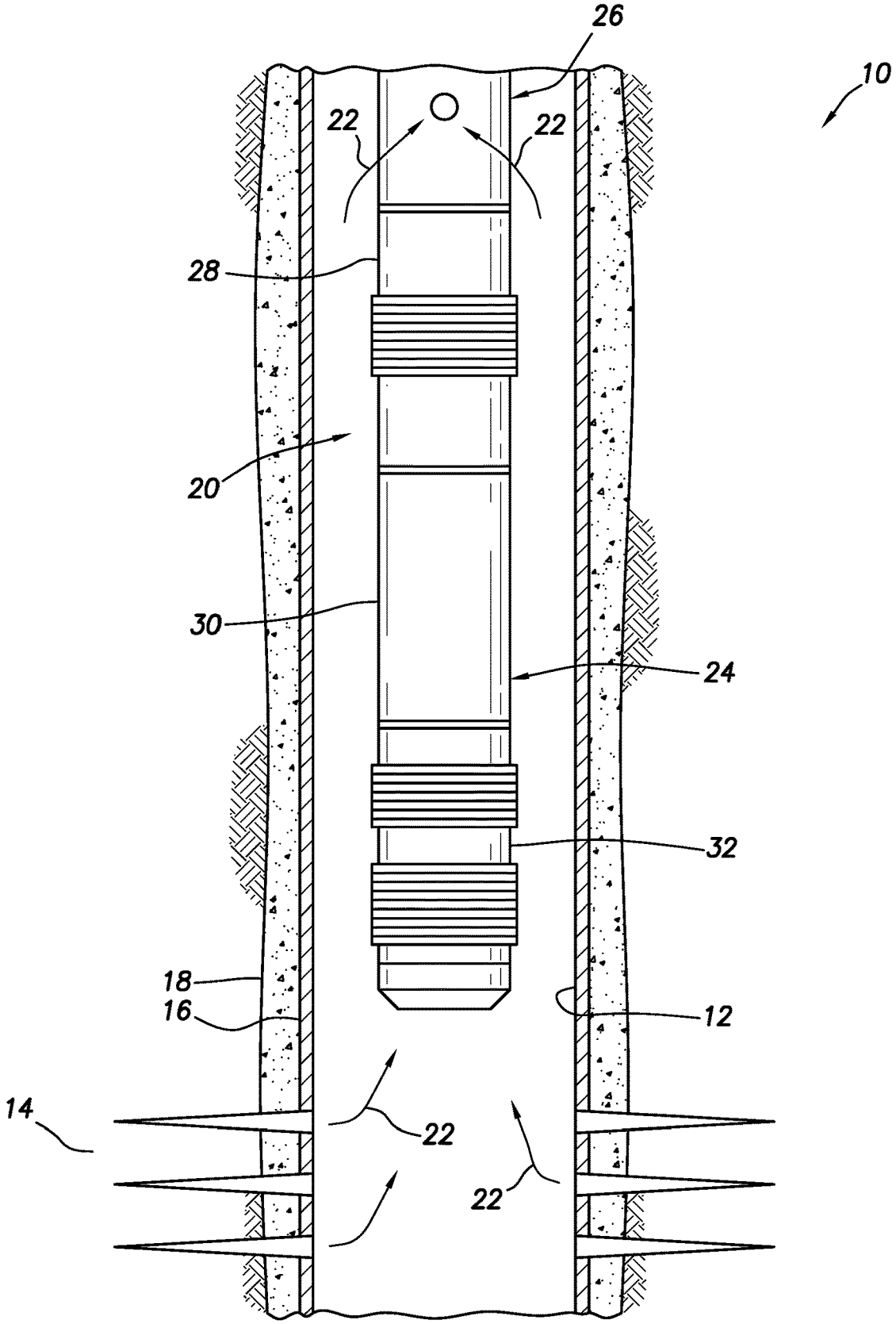
FIG. 1 is a representative partially cross-sectional view of an example of a well system and associated method which can embody principles of this disclosure.

Subterranean oil and gas wells are subject to problems with corrosion, paraffin, scale, H2S and other conditions that hinder optimum production. These conditions can cause deterioration of pumps, tubing, sucker rods, casing and other components that comprise the equipment that enable production of hydrocarbons to the surface.

In an example described more fully below, a method for alleviating such conditions (or other conditions) includes the use of a downhole chemical treatment assembly. The assembly can contain water soluble solid chemical blends and is preferably installed in a wellbore prior to production of fluids from a well. Fluids could be produced from the well before a particular assembly is installed.

Produced wellbore fluids come into contact with the solid chemical treatment through openings in the assembly. The solid chemical treatment liquifies as it is exposed to fluid and is slowly dispersed within the wellbore, thereby mixing with and treating the produced fluids.

The dispersion of chemical may be regulated by sections of welded wire screen which cover openings in the assembly. A single assembly or "stacked" multiple assemblies may be installed, depending on well conditions, production numbers and severity of well problems.

On occasion, well completions are pulled for repair or maintenance. When pulled, a downhole chemical treatment assembly may still be relatively full of solid chemical treatment, or flow through the screens could be blocked or restricted. In such cases, pressure may be trapped in the assembly when it is retrieved to surface.

Using the principles of this disclosure, the possibility for fluids and/or solid chemical to be forcibly ejected from the assembly as one section is disconnected from another section of the downhole chemical treatment assembly is reduced or eliminated. This enhances the safety of personnel in the vicinity and reduces potential harm to the environment.

An example of a pressure containment valve for a downhole chemical treatment assembly depicted in the accompanying drawings prevents the release of pressure when one section of the assembly is disconnected from another section. The pressure containment valve is spring-loaded and is positioned within box and pin (female and male, respectively) connectors of the assembly. As sections of the assembly are connected together, opposing valve shafts are pressed together, which opens the valves, thereby allowing communication between interior flow passages of the downhole chemical treatment assembly sections.

When the connectors are disconnected, the shafts pull away from each other, causing the valves to close. In single section installations, the valve stays closed and continues to isolate any pressure. The section(s) may then be brought to a refurbishing facility where the pressure is released under safe, controlled conditions.

The pressure containment valves may be used with 2⅜", 2⅞", 3⅛" or 4½" (or any other) outside diameter tools. In the example depicted in the drawings, the pressure containment valves are housed within a socketed collar and a socketed pin which are welded to outer housings of the downhole chemical treatment assembly.

The example pressure containment valve includes a valve closure, valve seat, valve seat retaining snap ring, valve spring, spring retainer and retainer pin. The valve seat retaining snap ring holds the valve seat in position, and the spring retainer and retainer pin hold the spring in place. A shaft of the valve closure has a selected length to engage with an opposing pressure containment valve's closure shaft.

As connectors are screwed together, in this example, the shafts of the pressure containment valves contact each other and push the valve closures away from the seats, thereby opening the valves. When the connectors are disconnected, the shafts separate, and the springs cause the valve closures to close against the valve seats.

In a single section configuration, the upper connector includes a socketed collar with a no-flow nipple attached. The lower connector includes a socketed collar connected to a bull plug. The socketed collar contains an internal plug which prevents any chemical treatment from falling out of the downhole chemical treatment assembly if the bull plug is removed.

In a two section downhole chemical treatment assembly, the upper connector of an upper section includes a socketed collar with a no-flow nipple. The lower connector of the upper section includes a socketed pin with a pressure containment valve. The upper connector of the lower section includes a socketed collar with a pressure containment valve, and the lower connector includes a socketed collar with an internal plug and a bull plug secured therein.

In a three or more section downhole chemical treatment assembly, the upper connector of the upper section includes a socketed collar with a no-flow nipple. The lower connector of the upper section includes a socketed pin with a pressure containment valve. The upper connector of each intermediate section includes a socketed collar with a pressure containment valve. The lower connector of each intermediate section includes a socketed pin with a pressure containment valve. The upper connector of the lower section includes a socketed collar with a pressure containment valve, and the lower connector includes a socketed collar with an internal plug and a bull plug secured therein.

When the valve shafts are engaged, and the valve closure is disengaged from the valve seat, the pressure containment valve is open, thereby allowing communication between the downhole chemical treatment assembly sections. This allows the wellbore fluids to interact with the solid chemical treatment within the sections. This communication between the sections provides for uniform dispersion of the chemical treatment as it liquefies over time and is released into the wellbore. When the well completion is pulled for repair or due to failure, and the individual sections of the downhole chemical treatment assemblies are disconnected from each other, any pressure which has accumulated within them is contained.

Once the sections are out of the well and disconnected from each other, they may be taken to a refurbishing facility that is equipped with appropriate apparatus to relieve the pressure inside the sections. The apparatus may include a cowl that is lowered over end(s) of the section containing the pressure. A mechanical, hydraulic or pneumatic plunger mechanism may then be used to depress the shaft of the valve closure, thereby allowing pressure inside the section to be released. Any expelled material is directed by the cowl into a container for disposal.

Once pressure has been relieved, the valve seat retaining ring can be removed, thereby allowing the valve seat, valve closure, retainer pin, valve spring and spring retainer, to be removed. This will also allow removal of any remaining chemical treatment remaining inside the section.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 penetrates an earth formation 14. The wellbore 12 is lined with casing 16 and cement 18.

In other examples, portions of the wellbore 12 in which the principles of this disclosure are practiced may be uncased or open hole. Although the wellbore 12 is depicted in FIG. 1 as being generally vertical, in other examples the wellbore could be generally horizontal or otherwise inclined from vertical. Thus, the scope of this disclosure is not limited to any particular details of the well as representatively illustrated in FIG. 1.

A well completion 20 has been installed in the wellbore 12. The completion 20 facilitates production of well fluids 22 (such as, oil, gas, gas condensates, water, etc.) from the well.

As depicted in FIG. 1, the completion 20 includes a downhole chemical treatment assembly 24 connected to a production tubing string 26. The chemical treatment assembly 24 is used to treat the well fluids 22 as they are produced into the tubing string 26 and flowed to the surface.

This treatment of the fluids 22 can, for example, prevent buildup of paraffins or scale in the tubing string 26, prevent corrosion of the tubing string, mitigate $H_2S$ production, etc. The scope of this disclosure is not limited to any particular purpose for treating the fluids 22.

In the FIG. 1 example, the chemical treatment assembly 24 includes three sections—an upper section 28, an intermediate section 30 and a lower section 32. In other examples, one, two or any other number of sections may be used.

The sections 28, 30, 32 are connected together before or as they are installed with the completion 20 into the well. When or after the completion 20 is retrieved from the well, the sections 28, 30, 32 are disconnected from each other.

Figure 2:
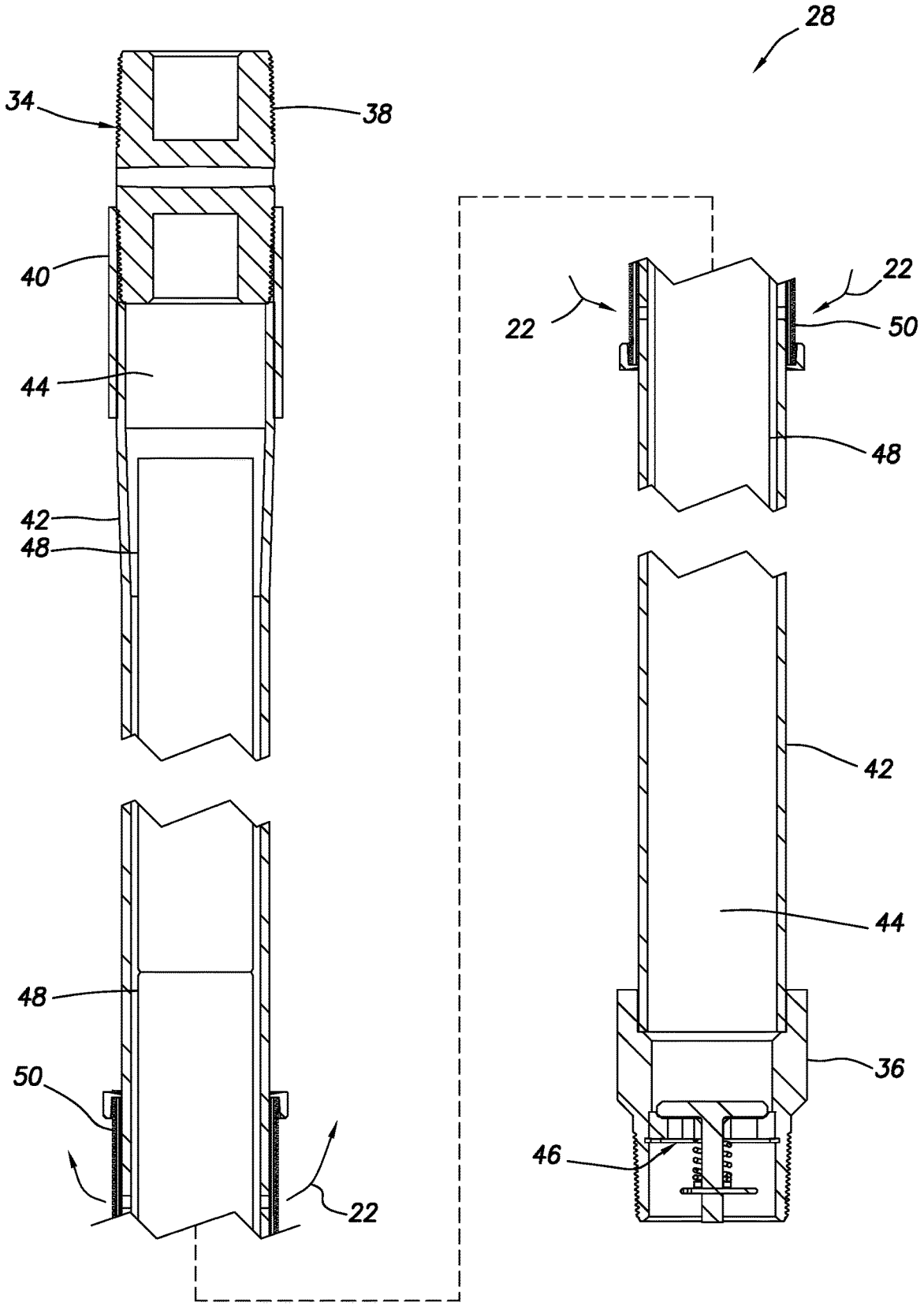
FIG. 2 is a representative cross-sectional view of an example of an upper section of a chemical treatment well tool assembly that may be used in the system and method of FIG. 1.

Referring additionally now to FIG. 2, a cross-sectional view of an example of the upper section 28 is representatively illustrated. In this example, the upper section 28 includes an upper connector 34 for connecting the upper section 28 to the tubing string 26, and a lower connector 36 for connecting the upper section to the intermediate section 30. Thus, the upper section 28 is configured to be connected between the tubing string 26 and the intermediate section 30, although in other examples the upper section could be otherwise positioned.

The upper connector 34 comprises a "no-flow" nipple 38 that is threaded into a socketed collar 40. A generally tubular outer housing 42 is welded to the collar 40. The nipple 38 blocks off a flow passage 44 that extends longitudinally through the outer housing 42.

The lower connector 36 comprises a socketed pin and is welded to a lower end of the outer housing 42. A pressure containment valve 46 is secured within the lower connector 36. The pressure containment valve 46 permits selective communication with the flow passage 44.

One or more chemical treatments 48 are contained in the flow passage 44 of the outer housing 42. A screen 50 provides for filtered flow between the flow passage 44 and an exterior of the upper section 28. In this manner, the well fluids 22 can enter the flow passage 44, contact the chemical treatments 48, and the treated fluids can return to the exterior of the upper section 28. Thus, the chemical treatment 48 leaches into the produced well fluids 22.

The pressure containment valve 46 is closed, thereby preventing communication with the flow passage 44 through the lower connector 36. However, when the upper section 28 is connected to the intermediate section 30 as described more fully below, the pressure containment valve 46 will be opened.

Figure 3:
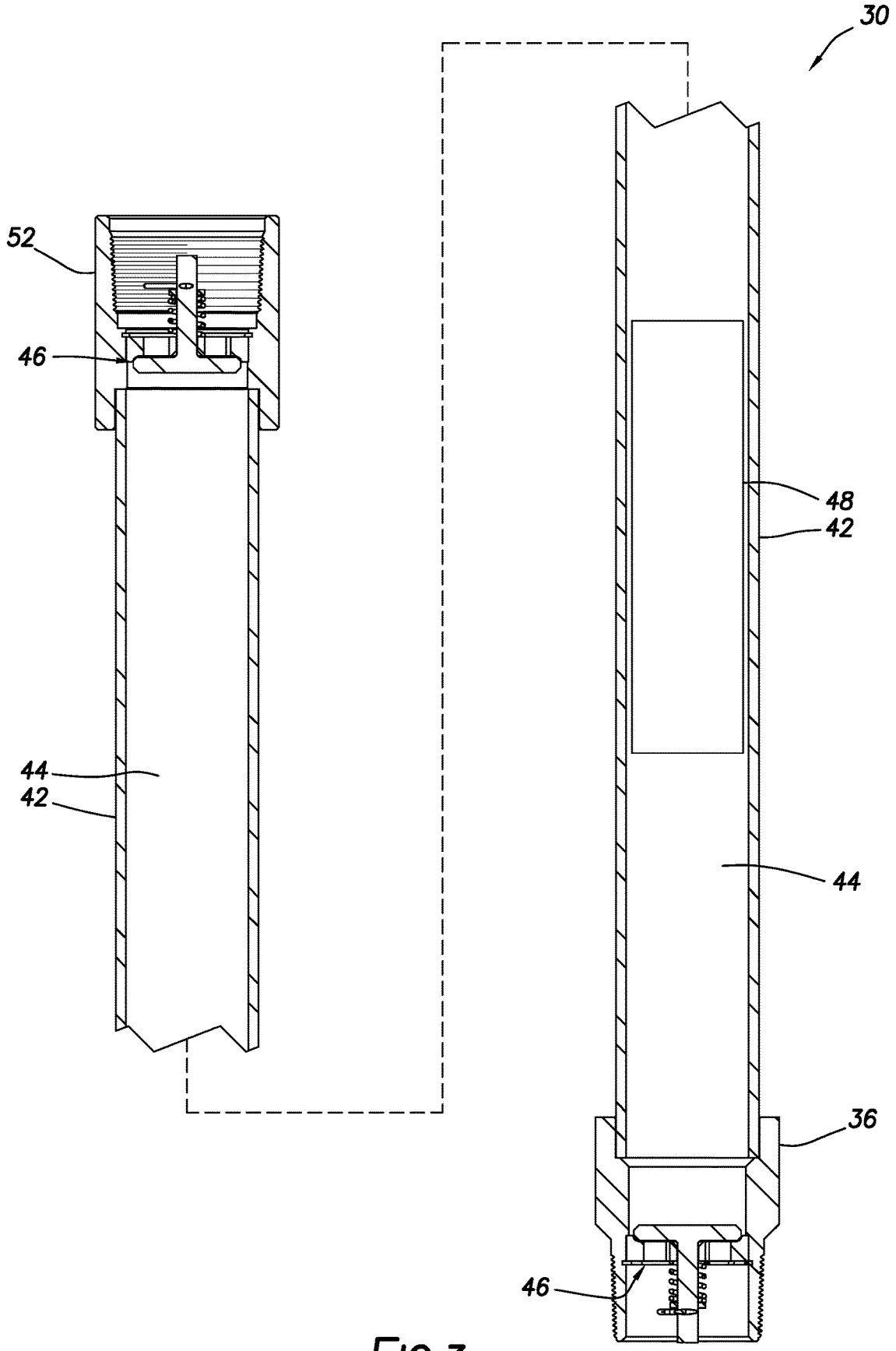
FIG. 3 is a representative cross-sectional view of an example of an intermediate section of the chemical treatment well tool assembly.

Referring additionally now to FIG. 3, a cross-sectional view of an example of the intermediate section 30 is representatively illustrated. Components of the intermediate section 30 which are similar to components of the upper section 28 described above are indicated in FIG. 3 using the same reference numbers.

As depicted in FIG. 3, the intermediate section 30 includes the outer housing 42 with one or more of the chemical treatments 48 in the flow passage 44. The lower connector 36 is welded to the lower end of the outer housing 42 and contains the pressure containment valve 46.

Note that a screen 50 is not provided on the outer housing 42. However, in other examples one or more screens could be provided, so that communication is permitted between the flow passage 44 and the exterior of the intermediate section 30 through the outer housing 42.

An upper connector 52 is welded to an upper end of the outer housing 42. The upper connector 52 comprises a socketed collar or box connection. A pressure containment valve 46 is secured in the upper connector 52 to provide selective communication with the flow passage 44 through the upper connector.

The pressure containment valves 46 are closed as depicted in FIG. 3. However, when the intermediate section 30 is connected to the upper section 28 the valve 46 in the upper connector 52 will be opened, and when the intermediate section is connected to the lower section 32 the valve in the lower connector 36 will be opened. With the valves 46 opened, the flow passage 44 will be in communication with the flow passages 44 in the upper and lower sections 28, 32.

Figure 4:
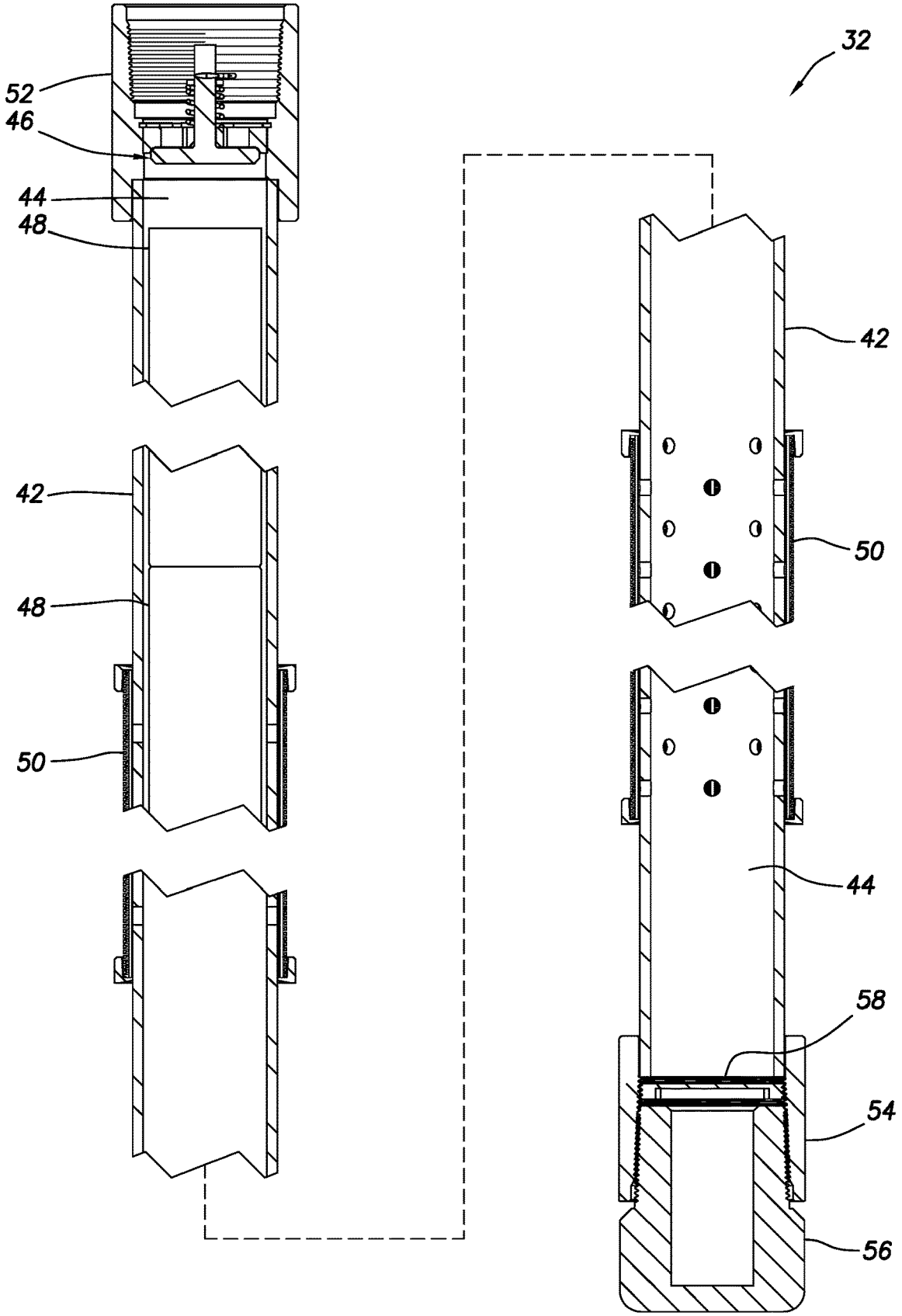
FIG. 4 is a representative cross-sectional view of an example of a lower section of the chemical treatment well tool assembly.

Referring additionally now to FIG. 4, a cross-sectional view of an example of the lower section 32 is representatively illustrated. Components of the lower section 32 which are similar to components of the upper section 28 or intermediate section 30 described above are indicated in FIG. 4 using the same reference numbers.

As depicted in FIG. 4, the lower section 32 includes two of the screens 50 for providing communication between the flow passage 44 and an exterior of the outer housing 42. Any number of screens, or no screens, may be provided in other examples.

A lower connector 54 is welded to a lower end of the outer housing 42. The lower connector 54 comprises a socketed collar or box connection. A bull plug 56 closes off a lower end of the flow passage 44. A generally disc-shaped internal plug 58 is threaded into the connector 54 and supports the chemical treatments 48 in the flow passage 44.

The pressure containment valve 46 in the upper connector 52 is closed as depicted in FIG. 4. However, when the lower connector 36 of the intermediate section 30 is connected to the upper connector 52 of the lower section 32, the valve in the upper connector 52 will be opened. With the valve 46 opened, the flow passage 44 in the lower section 32 will be in communication with the flow passage 44 in the intermediate section 30.

Figure 5:
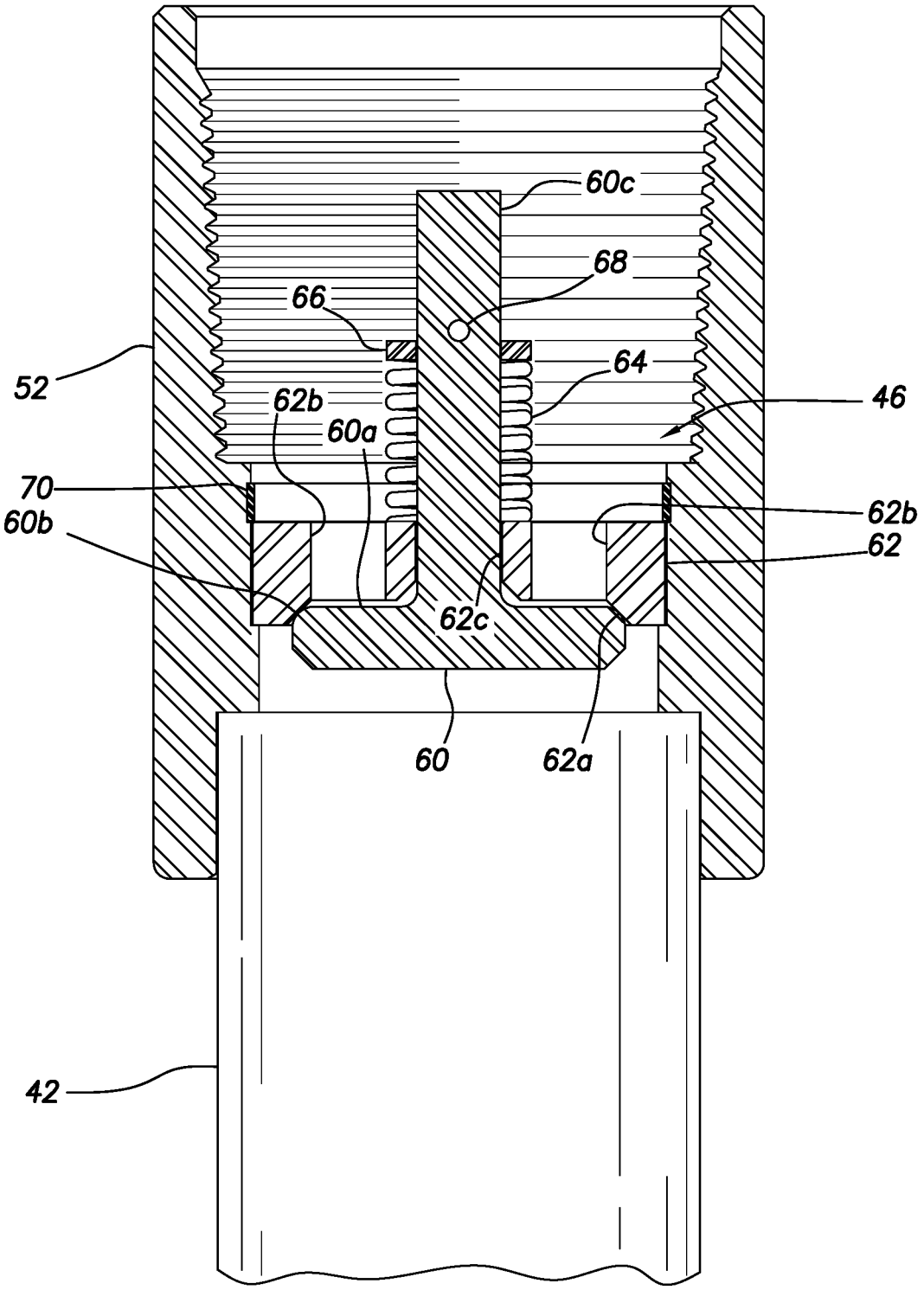
FIG. 5 is a representative cross-sectional view of a pressure containment valve that may be used with the chemical treatment well tool assembly of FIGS. 2-4.

Referring additionally now to FIG. 5, a cross-sectional view of an example of the pressure containment valve 46 is representatively illustrated. In this example, the pressure containment valve 46 is secured in the upper connector 52, but the valve may be similarly secured in the lower connector 36 (see FIG. 6).

In the FIG. 5 example, the pressure containment valve 46 includes a valve closure 60, a valve seat 62, a valve spring 64, a spring retainer 66, a retainer pin 68 and a snap ring 70. As depicted in FIG. 5, the closure 60 is sealingly engaged with the seat 62, thereby preventing flow through the valve 46 in the upper connector 52.

The closure 60 includes a generally disc-shaped body 60*a* with a sealing surface 60*b* thereon configured to sealingly engage a sealing surface 62*a* on the seat 62. A stem 60*c* extends longitudinally outward from the body 60*a* of the closure 60.

When the sealing surfaces 60*b*, 62*a* are in sealing contact, flow through ports 62*b* of the seat 62 is prevented. When the sealing surfaces 60*b*, 62*a* are spaced apart from each other, flow through the ports 62*b* is permitted.

The stem 60*c* extends through a central opening 62*c* of the seat 62. The spring 64 encircles the stem 60*c* and is retained in compression between the seat 62 and the spring retainer 66. The retainer pin 68 prevents displacement of the spring retainer 66 relative to the stem 60*c*.

The spring 64 biases the closure 60 toward sealing engagement with the seat 62. However, if a longitudinal force is exerted against the stem 60*c* (in a downward direction as viewed in FIG. 5), such that the biasing force of the spring 64 is overcome, the closure 60 will displace out of sealing engagement with the seat 62, so that flow will be permitted through the ports 62*b*.

Figure 6:
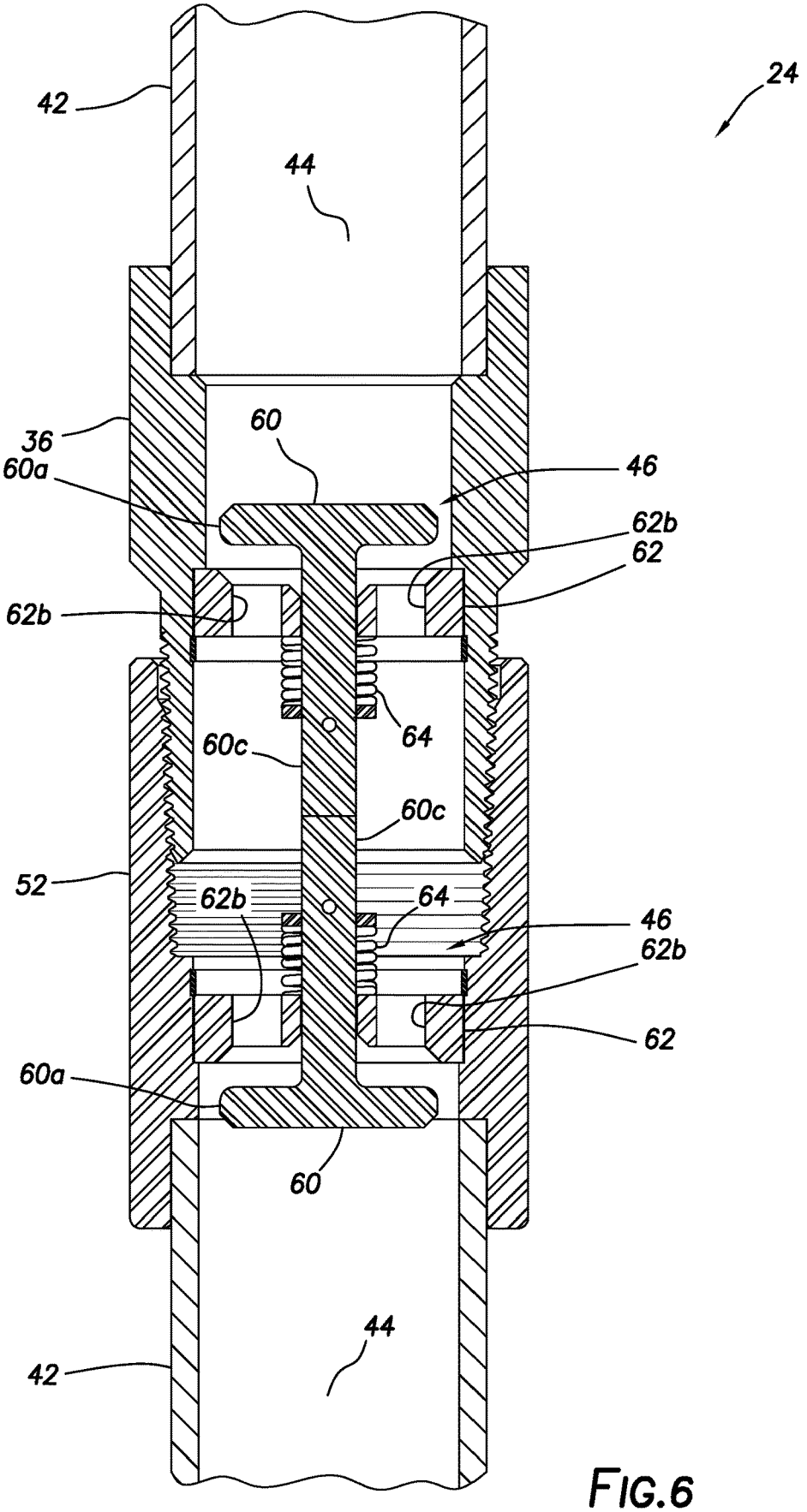
FIG. 6 is a representative cross-sectional view of a connection between sections of the chemical treatment well tool assembly.

Referring additionally now to FIG. 6, a cross-sectional view of a portion of the chemical treatment assembly 24 is representatively illustrated. In this view, the lower and upper connectors 36, 52 are operatively connected (such as, by threading the connectors together), so that the pressure containment valves 46 therein are opened.

When the lower and upper connectors 36, 52 are separated (not operatively connected to each other), the pressure containment valves 46 are closed (e.g., as in FIG. 5). In that case, the flow passages 44 in the various sections 28, 30, 32 are isolated from each other and from the exterior environment via the connectors 36, 52. With the valves 46 closed, the sections 28, 30, 32 can be safely handled and transported.

However, when the connectors 36, 52 are operatively connected to each other as viewed in FIG. 6, the flow passages 44 in the connected sections 28, 30, 32 are in communication with each other via the open valves 46. This enables the well fluids 22 (see FIG. 1) to flow through the connectors 36, 52 (via the ports 62*b*) between the sections 28, 30, 32, which promotes more uniform contact between the well fluids and the chemical treatments 48 in the various sections of the assembly 24.

The lower and upper connectors 36, 52 depicted in FIG. 6 could be those at a connection between the upper section 28 and the intermediate section 30, or between the intermediate section 30 and the lower section 32. If an intermediate section 30 is not used in the assembly 24, the lower and upper connectors 36, 52 depicted in FIG. 6 could be those at a connection between the upper section 28 and the lower section 32. If multiple intermediate sections 30 are used in the assembly 24, the lower and upper connectors 36, 52 depicted in FIG. 6 could be those at a connection between two adjacent intermediate sections.

When the lower and upper connectors 36, 52 are connected to each other, the valves 46 are displaced longitudinally toward each other (e.g., as a result of threading one connector into the other connector). Note that it is not necessary for connectors to be threaded together in keeping with the principles of this disclosure, since other means may be used to connect the connectors (such as, a breech-lock type of connection, a latch connection, etc.). Thus, the scope of this disclosure is not limited to any particular technique for operatively connecting the connectors 36, 52.

The longitudinal displacement of the valves 46 toward each other also displaces the valve stems 60*c* toward each other. Eventually, the valve stems 60*c* contact or abut each other, and continued displacement of the valves 46 toward each other overcomes the biasing forces exerted by the springs 64, thereby causing the bodies 60*a* to disengage from the seats 62. In this example, the seats 62 continue to displace toward each other after the valve stems 60*c* have contacted each other and can no longer displace toward each other.

When the lower and upper connectors 36, 52 are disconnected from each other, the valves 46 are displaced longitudinally away from each other (e.g., as a result of unthreading one connector from the other connector). The longitudinal displacement of the valves 46 away each other also displaces the valve seats 62 away from each other. Eventually, the bodies 60*a* engage the seats 62, since the springs 64 bias the bodies toward the seats. The valve stems 60*c* will no longer contact or abut each other as the connectors 36, 52 are separated.

Thus, as described above, the valves 46 are open, the flow passages 44 are in communication with each other, flow is permitted through the ports 62*b*, and the valve closure 60 is not sealingly engaged with the seat 62, when the connectors 36, 52 are operatively connected to each other. The valves 46 are closed, the flow passages 44 are not in communication with each other, flow is prevented through the ports 62*b*, and the valve closure 60 is sealingly engaged with the seat 62, when the connectors 36, 52 are disconnected from each other.

It may now be fully appreciated that the above disclosure provides significant advancements to the art of constructing and utilizing chemical treatment assemblies for use in wells. In examples described above, connectors 36, 52 of various sections 28, 30, 32 of the chemical treatment assembly 24 can be disconnected from each other, without the flow passages 44 in the sections being placed in communication with the external environment via the connectors.

The above disclosure provides to the art a chemical treatment assembly 24 for use in a subterranean well. In one example, the chemical treatment assembly 24 can comprise: a first section 28, 30, 32 including a first pressure containment valve 46 that selectively permits and prevents fluid communication with a first flow passage 44 in the first section 28, 30, 32, and a second section 28, 30, 32 including a second pressure containment valve 46 that selectively permits and prevents fluid communication with a second flow passage 44 in the second section 28, 30, 32, and in which the first and second pressure containment valves 46 are closed in response to disconnection of the first section from the second section.

The first and second pressure containment valves 46 may be opened in response to connection of the first section to the second section.

Each of the first and second pressure containment valves 46 may comprise a valve closure 60, and the valve closures 60 may disengage from each other in response to disconnection of the first section from the second section.

The first pressure containment valve 46 may be positioned in a first connector 36 of the first section, the second pressure containment valve 46 may be positioned in a second connector 52 of the second section, and the first and second pressure containment valves 46 may be closed in response to longitudinal displacement of the first and second connectors 36, 52 away from each other.

The first pressure containment valve 46 may comprise a first seat 62, the second pressure containment valve 46 may comprise a second seat 62. The first and second pressure containment valves 46 may be closed in response to longitudinal displacement of the first and second seats 62 away from each other.

Each of the first and second pressure containment valves 46 may comprise a valve closure 60, and the valve closures 60 may contact each other in response to connection of the first section to the second section. The first flow passage 44 may be placed in fluid communication with the second flow passage 44 in response to contact between the valve closures 60.

The above disclosure also provides to the art a method of containing pressure in at least first and second sections 28, 30, 32 of a chemical treatment assembly 24. In one example, the method can comprise: installing a first pressure containment valve 46 in the first section of the chemical treatment assembly 24, and installing a second pressure containment valve 46 in the second section of the chemical treatment assembly 24, the first and second pressure containment valves 46 being configured to close in response to disconnecting the first section from the second section.

The step of installing the first pressure containment valve 46 may comprise sealingly engaging a first valve closure 60 of the first pressure containment valve 46 with a first valve seat 62 of the first pressure containment valve 46, the first pressure containment valve 46 being configured to open in response to relative displacement between the first valve closure 60 and the first valve seat 62.

The step of installing the second pressure containment valve 46 may comprise sealingly engaging a second valve closure 60 of the second pressure containment valve 46 with a second valve seat 62 of the second pressure containment valve 46, the second pressure containment valve 46 being configured to open in response to relative displacement between the second valve closure 60 and the second valve seat 62.

The disconnecting step may comprise displacing the first and second valve seats 62 away from each other. The disconnecting step may comprise preventing flow through ports 62*b* formed in each of the first and second valve seats 62.

The first and second pressure containment valves 46 may be configured to open in response to connecting the first section to the second section.

The connecting step may comprise displacing the first and second valve seats 62 toward each other. The connecting step may comprise permitting flow through ports 62*b* formed in each of the first and second valve seats 62.

Also described above is a chemical treatment assembly 24 for use in a subterranean well, the chemical treatment assembly comprising: an outer housing 42, a flow passage 44 extending longitudinally through the outer housing 42, a chemical treatment 48 positioned in the flow passage 44, and a pressure containment valve 46 that selectively permits and prevents fluid communication with the flow passage 44 through the pressure containment valve 46.

The pressure containment valve 46 may be positioned in a connector 36, 52 secured to the outer housing 42. The pressure containment valve 46 may comprise a valve closure 60 that is biased toward sealing engagement with a valve seat 62.

A valve spring 64 may bias the valve closure 60 toward the valve seat 62. The valve spring 64 may bias the valve closure 60 longitudinally away from the flow passage 44.

The valve closure 60 may comprise a valve stem 60*c* that extends longitudinally outward relative to the outer housing 42. The valve stem 60*c* may extend longitudinally outward relative to the flow passage 44.

Ports 62*b* may be formed through the valve seat 62. Sealing engagement between the valve closure 60 and the valve seat 62 may prevent fluid communication between the flow passage 44 and the ports 62*b*.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A chemical treatment assembly for use in a subterranean well, the chemical treatment assembly comprising:

a first section including a first pressure containment valve that selectively permits and prevents fluid communication with a first flow passage in the first section, in which the first pressure containment valve comprises a first valve seat, a first valve closure, and a first biasing device which urges a sealing surface of the first valve closure into sealing engagement with the first valve seat, in which the sealing surface of the first valve closure is on a first side of the first valve seat, and in which the first biasing device is on a second side of the first valve seat opposite the first side; and a second section including a second pressure containment valve that selectively permits and prevents fluid communication with a second flow passage in the second section, the second section being configured for threaded connection to the first section, in which the second pressure containment valve comprises a second valve seat, a second valve closure, and a second biasing device which urges a sealing surface of the second valve closure into sealing engagement with the second valve seat, in which the sealing surface of the second valve closure is on a first side of the second valve seat, and in which the second biasing device is on a second side of the second valve seat opposite the first side, and in which the first and second pressure containment valves are configured to open in response to contact between the first and second valve closures as a male thread of the first section is screwed into a female thread of the second section.

2. The chemical treatment assembly of claim 1, in which the first and second pressure containment valves are configured to close as the first section is unscrewed from the second section.

3. The chemical treatment assembly of claim 1, in which the first and second valve closures disengage from each other when the first section is unscrewed from the second section.

4. The chemical treatment assembly of claim 1, in which the first pressure containment valve is positioned in a first connector of the first section, the second pressure containment valve is positioned in a second connector of the second section, and the first and second pressure containment valves are closed in response to longitudinal displacement of the first and second connectors away from each other.

5. The chemical treatment assembly of claim 1, in which the first and second pressure containment valves are closed in response to longitudinal displacement of the first and second seats away from each other.

6. The chemical treatment assembly of claim 1, in which the first flow passage is placed in fluid communication with the second flow passage in response to the contact between the first and second valve closures.

7. The chemical treatment assembly of claim 1, in which the male thread is formed on a pin connector of the chemical treatment assembly.

8. The chemical treatment assembly of claim 1, in which the female thread is formed on a box connector of the chemical treatment assembly.

9. The chemical treatment assembly of claim 1, in which ports are formed in each of the first and second valve seats, and in which the ports permit flow through the first and second valve seats when the first and second pressure containment valves are open.

10. A method of containing pressure in at least first and second sections of a chemical treatment assembly, the method comprising:

installing a first pressure containment valve in the first section of the chemical treatment assembly, in which the first pressure containment valve comprises a first valve seat, a first valve closure, and a first biasing device which urges a sealing surface of the first valve closure into sealing engagement with the first valve seat, in which the sealing surface of the first valve closure is on a first side of the first valve seat, and in which the first biasing device is on a second side of the first valve seat opposite the first side;

installing a second pressure containment valve in the second section of the chemical treatment assembly, in which the second pressure containment valve comprises a second valve seat, a second valve closure, and a second biasing device which urges a sealing surface of the second valve closure into sealing engagement with the second valve seat, in which the sealing surface of the second valve closure is on a first side of the second valve seat, and in which the second biasing device is on a second side of the second valve seat opposite the first side;

screwing a male thread of the first section into a female thread of the second section, thereby displacing the first and second valve seats longitudinally toward each other, and thereby opening the first and second pressure containment valves; and closing the first and second pressure containment valves in response to unscrewing the male thread of the first section from the female thread of the second section.

11. The method of claim 10, in which the installing the first pressure containment valve comprises sealingly engaging the first valve closure with the first valve seat of the first pressure containment valve, the first pressure containment valve being configured to open in response to relative displacement between the first valve closure and the first valve seat.

12. The method of claim 11, in which the installing the second pressure containment valve comprises sealingly engaging the second valve closure with the second valve seat of the second pressure containment valve, the second pressure containment valve being configured to open in response to relative displacement between the second valve closure and the second valve seat.

13. The method of claim 12, in which the unscrewing comprises displacing the first and second valve seats away from each other.

14. The method of claim 12, in which the unscrewing comprises preventing flow through ports formed in each of the first and second valve seats.

15. The method of claim 12, in which the screwing comprises permitting flow through ports formed in each of the first and second valve seats.

16. The method of claim 10, in which the male thread is formed on a pin connector of the chemical treatment assembly.

17. The method of claim 10, in which the female thread is formed on a box connector of the chemical treatment assembly.

* * * * *